United States Patent [19]

Darragh

[11] 4,123,025

[45] Oct. 31, 1978

[54] PYRAMIDAL HANGER FOR PLANTS OR LIKE ORNAMENTS

[75] Inventor: Donald R. Darragh, Tulsa, Okla.

[73] Assignee: James V. Snow, Tulsa, Okla.

[21] Appl. No.: 805,846

[22] Filed: Jun. 13, 1977

[51] Int. Cl.[2] ..... A47H 1/16; F16B 45/00

[52] U.S. Cl. ..... 248/303; 248/304

[58] Field of Search ..... 47/67; 248/216.2, 218.1, 248/218.2, 218.3, 249, 302, 303, 304, 318

[56] References Cited

U.S. PATENT DOCUMENTS

| | | | |
|---|---|---|---|
| D. 168,820 | 2/1953 | Beltramini | 248/302 UX |
| 808,142 | 12/1905 | Danhour | 248/302 X |
| 1,744,382 | 1/1930 | Hensel | 248/302 X |
| 1,831,190 | 11/1931 | Parker | 248/302 X |
| 2,073,312 | 3/1937 | Miller | 248/303 X |
| 3,580,534 | 5/1971 | Lindsey | 248/219.1 |

FOREIGN PATENT DOCUMENTS

| | | | |
|---|---|---|---|
| 181,993 | 5/1955 | Fed. Rep. of Germany | 47/67 |
| 1,189,689 | 3/1965 | Fed. Rep. of Germany | 248/249 |
| 26,559 | 3/1909 | Sweden | 248/249 |
| 199,955 | 7/1923 | United Kingdom | 248/249 |

*Primary Examiner*—Lawrence J. Staab

*Attorney, Agent, or Firm*—William S. Dorman

[57] ABSTRACT

A hanger for supporting plants or the like from a vertical wall in horizontally spaced relation and providing for simple installation without unduly defacing the wall, comprising three legs, each leg having a first end and a second end opposite from the first end whereby the first ends of the three legs are spaced in such a fashion as to form a triangular base. The three legs extend convergingly away from the base and are connected together at their second ends to form a common vertex point being provided with a hook for holding a plant or the like. The first ends of two of the legs are connected by a cross-piece near the triangular base.

2 Claims, 4 Drawing Figures

PYRAMIDAL HANGER FOR PLANTS OR LIKE ORNAMENTS

BACKGROUND OF THE INVENTION

1. Field of the Invention

This invention relates to a hanger for ornaments or plants. More particularly, this invention relates to a durable, sturdy hanger for ornaments or plants and capable of holding a great amount of weight without having a large or bulky structure which may be inexpensively and simply produced and may be installed without unduly defacing a wall.

2. Description of the Prior Art

Ornaments and plants are popular items and provide for embellishment of rooms. In many instances these ornaments or plants are suspended from walls or ceilings. Cable or string which holds the ornament or plant may itself be a decorative item. Suspension from a ceiling may be undesirable as being impractical or it may be undesirable as requiring excessive defacing of the ceiling during installation. If suspension from a wall is desired, the ornament or plant should be suspended away from the vertical wall. Excessive defacing of a vertical wall is likewise generally undesirable.

Therefore, it is the principal object and purpose of this invention to provide a durable device for suspension of ornaments or plants from a vertical wall and capable of holding a great amount of weight without having a large or bulky structure. The invention may be simply installed without the necessity of connection to a ceiling and, since only one connecting point is utilized, without unduly defacing a wall. The invention provides a hanger which may be inexpensively and simply produced.

SUMMARY OF THE INVENTION

The present invention designed for suspension of plants or ornaments from a vertical wall, comprises a hanger in the form of a triangular-based, pyramidal-shaped frame. When the hanger is in position against the wall, the base of the pyramid will be flush to the wall and the vertex of the pyramid will be at a point spaced from the wall. The hanger includes an arm which extends outwardly and upwardly from the vertex of the pyramid. An eye is formed at the upper end of the arm to engage a hook attached to the wall or molding. The eye, which would normally connect to a hook, is the only point of attachment of the hanger to the wall.

From the vertex of the pyramid, a pair of legs extends outwardly and divergently towards the wall. Where the legs touch against the wall, a connecting piece joins the legs together. The connecting piece does not lie flat against the wall however the connecting piece runs substantially horizontal and parallel to the wall.

A plant or ornament thus can be simply and easily suspended away from the wall without unduly defacing the wall by complicated installation.

DESCRIPTION OF THE PREFERRED EMBODIMENTS

Figure 1:
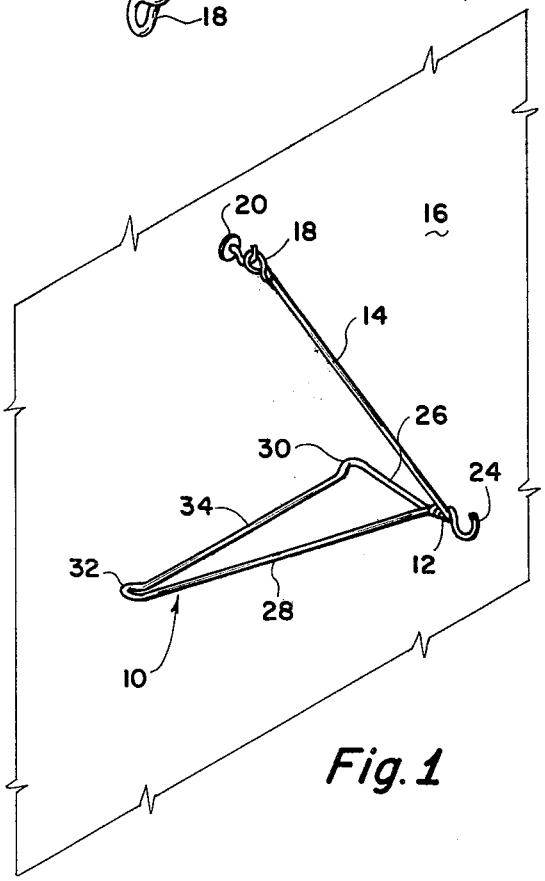
FIG. 1 is a perspective view of a hanger constructed in accordance with one embodiment of this invention showing the hanger attached to a vertical wall through use of a hook.

Referring to the drawings in detail, FIG. 1 shows a hanger 10 in the form of a triangular-based, pyramidal-shaped frame, with the base of the pyramid flush to a wall 16 and the vertex 12 of the pyramid being at a point farthest from the wall. The pyramid shape of the hanger 10 can best be seen in FIG. 2. The hanger may be made of wire, plastic, or any other sturdy, lightweight material. The hanger 10 includes a first leg or arm 14, extending outwardly and upwardly from the vertex 12 of the pyramid. When the hanger is in place against the wall, the arm 14 will be approximately at a 45° angle to the wall 16 from the floor as best seen in FIG. 3. An eye 18 is formed at the upper end of the arm 14 and is adapted to engage a hook 20 attached to the wall 16, or molding on the wall. The eye 18 holds the device in place to the wall and is the only connecting point necessary for the hanger. The hook 20 attached to the wall or molding is not a part of this invention.

Figure 4:
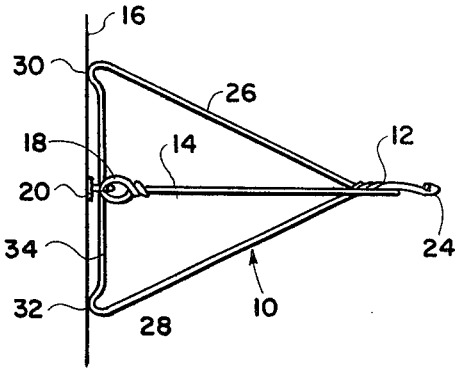
FIG. 4 is a top view of the hanger shown in FIG. 1.

A hook 24 is attached to the hanger 10 at the vertex 12 of the pyramid. It can be seen in FIG. 3 that an ornament or plant 26 which this invention holds will be attached to the hanger 10 at this point by means of string 30, for example. Referring to FIG. 4, from the bottom of the first leg or arm 14, at the vertex of the pyramid where the hook 24 is attached, two additional legs 26 and 28 extend outwardly and divergently downwardly towards the wall 16.

Adjacent the points of contact 30 and 32 where the legs 26, 28 touch against the wall 16, a connecting piece 34 joins these legs together. The connecting piece 34, runs horizontal and parallel to the wall 16. The connecting piece 34, however does not lie flat against the wall 16; rather, from the points of contact 30 and 32 with the wall 16, the connecting piece 34 bends inward from the points of contact 30 and 32 towards the vertex 12 of the pyramid and then runs parallel to the wall 16, connecting the legs 26 and 28 together.

Figure 2:
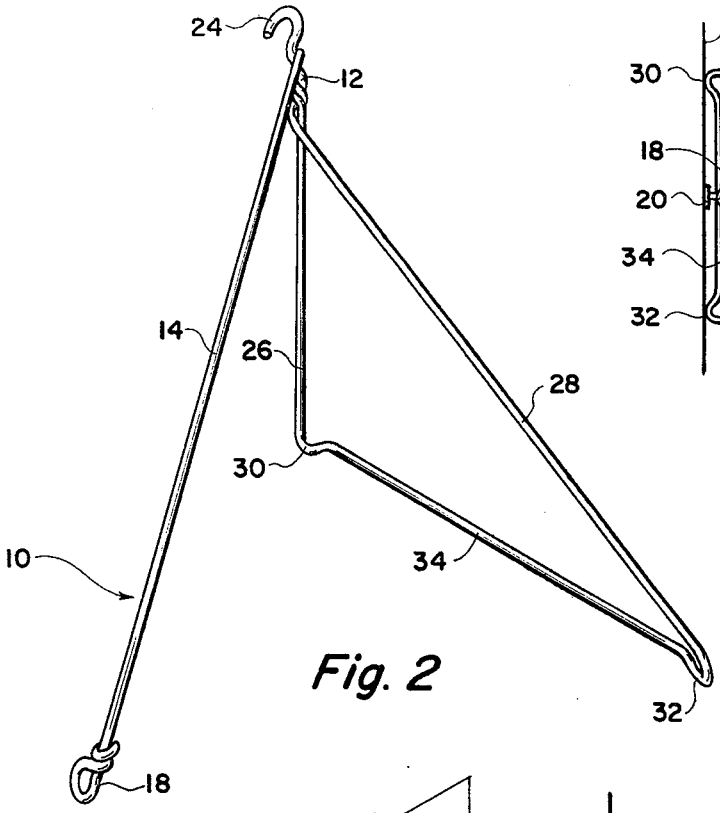
FIG. 2 is another perspective view of the hanger shown in FIG. 1.
Figure 3:
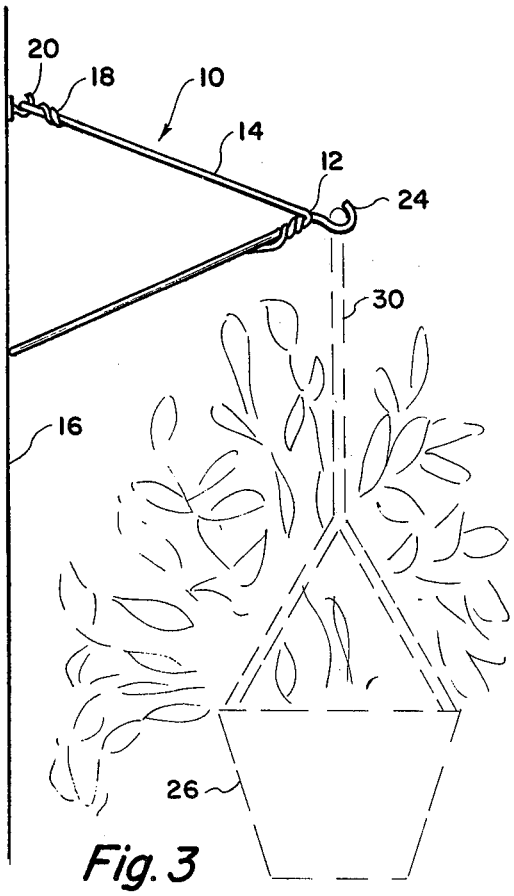
FIG. 3 is a side view of the hanger shown in FIG. 1 indicating, in dotted lines, the suspension of a plant in relation to a vertical wall.

Summarizing, and in particular relation to FIG. 2, the hanger 10 includes three legs 14, 26 and 28 whose lower ends are spaced to form the triangular base of a pyramid and whose upper ends are connected together to form the vertex 12 of this pyramid. An eye 18 is provided at the lower end of the leg 14 and a cross-piece 34 connects the lower ends of the other two legs 26 and 28. A hook 24 is provided at the vertex 12.

As shown in the drawings, the vertex 12 is formed by twisting the wires (the legs) around each other at this point. However, any convenient means of connection can be employed. It is also contemplated that the entire hanger 10 can be a one piece item made from molded plastic, etc.

Thus from the drawings it can be seem that a plant or ornament can be simply and easily suspended away for the wall 16 without unduly defacing the wall through complicated installation.

What is claimed is:

1. A pyramidal-shaped hanger for supporting plants or the like in horizontally spaced relation from a vertical wall comprising an arm adapted to extend downwardly and outwardly from an end of said arm which connects with said wall to a vertex point at the opposite end of said arm from said connecting end, a pair of legs connected to said arm only at said vertex point and extending divergently inward towards said wall from said vertex point, a substantially horizontal cross-piece connecting the ends of said legs opposite from the ends thereof which connect with said arm, and hook means at said vertex point.

2. A hanger for supporting plants or the like as set forth in claim 1 wherein said arm is provided with an eye at said connecting end.

* * * * *